US008834803B2

(12) United States Patent
Sunderland

(10) Patent No.: US 8,834,803 B2
(45) Date of Patent: Sep. 16, 2014

(54) ELECTRO HYDRODYNAMIC THRUSTER FOR DECONTAMINATING A DISPLAY CASE

(71) Applicant: Hussmann Corporation, Bridgeton, MO (US)

(72) Inventor: Ted W. Sunderland, Washington, MO (US)

(73) Assignee: Hussmann Corporation, Bridgeton, MO (US)

( * ) Notice: Subject to any disclaimer, the term of this patent is extended or adjusted under 35 U.S.C. 154(b) by 216 days.

(21) Appl. No.: 13/655,923

(22) Filed: Oct. 19, 2012

(65) Prior Publication Data

US 2014/0110278 A1 Apr. 24, 2014

(51) Int. Cl.
*B01J 19/08* (2006.01)
*A23B 7/015* (2006.01)

(52) U.S. Cl.
USPC ..... 422/186.04; 99/451; 426/237

(58) Field of Classification Search
USPC ..... 422/186.04; 99/451; 426/237
See application file for complete search history.

(56) References Cited

U.S. PATENT DOCUMENTS

| | | | |
|---|---|---|---|
| 2,765,975 | A | 10/1956 | Lindenblad |
| 4,528,228 | A | 7/1985 | Clevenger |
| 4,622,229 | A | 11/1986 | Toshitsugu |
| RE33,067 | E | 9/1989 | Corrigan |
| 4,961,322 | A | 10/1990 | Oguma et al. |
| 5,474,988 | A | 12/1995 | Demonchaux et al. |
| 5,502,979 | A | 4/1996 | Renard |
| 5,661,979 | A | 9/1997 | DeBoer |
| 5,771,790 | A | 6/1998 | Barrows |
| 5,982,102 | A | 11/1999 | Andrzej |
| 6,054,153 | A | 4/2000 | Carr et al. |
| 6,113,671 | A | 9/2000 | Garrett |
| 6,503,547 | B1 | 1/2003 | Lima |
| 7,296,422 | B2 | 11/2007 | Strohm et al. |
| 7,540,162 | B2 | 6/2009 | Nordstrom |
| 7,595,030 | B2 | 9/2009 | Joannou |

(Continued)

FOREIGN PATENT DOCUMENTS

| | | |
|---|---|---|
| EP | 1867346 | 12/2007 |
| JP | 2009074764 | 4/2009 |

OTHER PUBLICATIONS

Laroussi et al., "Evaluation of the roles of reactive species, heat, and UV radiation in the inactivation of bacterial cells by air plasmas at atmospheric pressure," article, (2003) Department of Electrical and Computer Engineering, Old Dominion University, Norfolk, USA, pp. 81-86.

(Continued)

*Primary Examiner* — Kishor Mayekar
(74) *Attorney, Agent, or Firm* — Michael Best & Friedrich LLP

(57) ABSTRACT

A display assembly for containing and displaying perishable products includes a case having at least one wall and defining an internal volume, a quantity of gas contained in the case, the gas including ethylene emitted from the perishable products, and an electro hydrodynamic thrust device positioned in the case. The electro hydrodynamic thrust device ionizes a portion of the quantity of gas. The ionized gas includes at least one reactive oxygen species, and the at least one reactive oxygen species reacts with the ethylene to break down the ethylene.

19 Claims, 2 Drawing Sheets

(56) References Cited

U.S. PATENT DOCUMENTS

| | | | |
|---|---|---|---|
| 2004/0050482 | A1 | 3/2004 | Abrams |
| 2004/0131736 | A1 | 7/2004 | Pan et al. |
| 2005/0089458 | A1 | 4/2005 | Oke |
| 2006/0032376 | A1 | 2/2006 | Osada et al. |
| 2007/0104841 | A1 | 5/2007 | Min et al. |
| 2007/0119699 | A1 | 5/2007 | Chambers et al. |
| 2008/0159910 | A1 | 7/2008 | Dick et al. |
| 2009/0169438 | A1 | 7/2009 | Bruggink |
| 2010/0196215 | A1 | 8/2010 | Woodbridge |
| 2011/0123694 | A1 | 5/2011 | Ryska et al. |
| 2013/0337121 | A1 * | 12/2013 | Sugano et al. ..... 426/232 |

OTHER PUBLICATIONS

Montie, et al., "An Overview of Research Using the One Atmosphere Uniform glow Discharge Plasma (OAUGDP) for Sterilization of Surfaces and Materials," IEEE Transactions on Plasma Science, 28(1) (2000) pp. 41-50.

* cited by examiner

ELECTRO HYDRODYNAMIC THRUSTER FOR DECONTAMINATING A DISPLAY CASE

BACKGROUND

The present invention relates to preserving perishable products in a display case.

SUMMARY

In one embodiment, the invention provides a display assembly for containing and displaying perishable products. The display assembly includes a case having at least one wall and defining an internal volume, a quantity of gas contained in the case, the gas including ethylene emitted from the perishable products, and an electro hydrodynamic thrust device positioned in the case. The electro hydrodynamic thrust device ionizes a portion of the quantity of gas. The ionized gas includes at least one reactive oxygen species, and the at least one reactive oxygen species reacts with the ethylene to break down the ethylene.

In another embodiment the invention provides a method of retrofitting a display case for displaying perishable food. The method includes inserting an electro hydrodynamic thrust device into the display case, connecting the electro hydrodynamic thrust device to a power source, and creating an ion wind with the electro hydrodynamic thrust device. The method further includes moving air through the electro hydrodynamic thrust device with the ion wind, ionizing the air in response to reacting the air with the ion wind, and creating reactive oxygen species in response to ionizing the air. The method further includes directing the reactive oxygen species into the display case with the thrust of the ion wind, sanitizing at least one surface in the display case with reactive oxygen species, and reacting ethylene with the reactive oxygen species to break down the ethylene in the display case, thereby reducing the quantity of ethylene in the display case.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
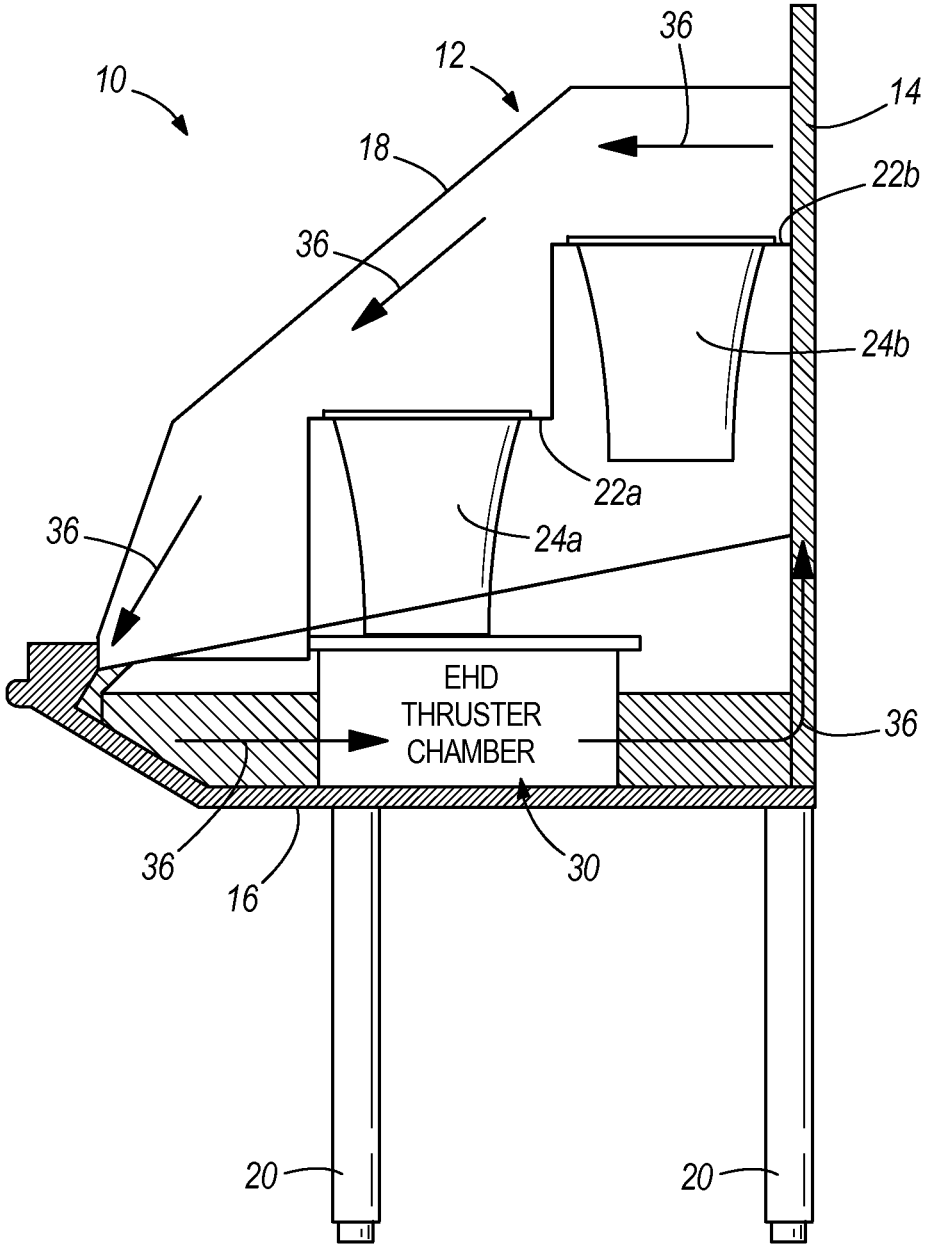
FIG. 1 is a schematic side view of a display case for supporting perishable products according to some aspects of the present invention.

FIG. 1 illustrates a display assembly 10 including a display case 12 that includes a back wall 14, a bottom wall 16, and a cover 18 that are supported on legs 20. The display case 12 has an internal volume that extends between the back wall 14, the bottom wall 16 and the cover 18. The illustrated display case 12 includes two shelves 22*a*, 22*b* each of which include at least one basket 24*a*, 24*b* for containing and displaying perishable goods, such as flowers. In another embodiment, the baskets 24*a*, 24*b* are omitted and produce (such as fruits and vegetables) are displayed on the shelves 22*a*, 22*b*. The cover 18 (typically made of clear glass) is moveable with respect to at least one of the back wall 14 and the bottom wall 16 to permit a user to access the perishable goods. In other constructions, no glass cover is used and the case has an open front and top to provide uninhibited access to the products within the case. Some cases have an open front and are closed on the top and at least some of the sides, whereas other cases have an open top and are closed some or all of the sides. In further constructions, the front and sides of the case are open and the top and back are closed. In still other constructions, the front, sides and top are open and only the back is closed.

Perishable goods often emit gasses as they are flowering (in the case of flowers) or ripening (in the case of produce). One such gas that is often produced is Ethylene. These gasses often speed up the flowering or the ripening and thus, shorten the shelf-life of the perishable goods. Further, produce often has some bacteria growing on at least one of its surfaces. The bacteria will multiply on the produce as well as on the shelves 22*a*, 22*b*, even in a refrigerated atmosphere, and especially in the non-refrigerated embodiment shown in FIG. 1. The bacteria often shorten the shelf-life of the perishable goods.

The display assembly 10 further includes at least one electro hydrodynamic (EHD) thruster 30. One such EHD device is described in U.S. Pat. No. 2,765,975 (hereinafter "U.S. Pat. No. 2,765,975"). This EHD device utilizes small wires spaced along a chamber. The small wires are connected to a positive voltage source which ionizes the molecules in close proximity to the charged wires. The voltage in the small wires and the ionized molecules create an ion wind which moves air through the chamber. In contrast to fans and other air-moving devices, the generated ion wind moves the air through the chamber without creating much if any noise.

One major difference between the present invention and the EDH of U.S. Pat. No. 2,765,975 is that the EHD of U.S. Pat. No. 2,765,975 includes a duct element 30 with ion neutralizing grids 34 that neutralize air prior to exiting the outlet orifice 32 (see col. 2, lines 57-69, FIG. 1). However, the present invention would omit such neutralizing elements because the ions are utilized to generate reactive oxygen species (ROS) such as atomic oxygen (O), ozone ($O_3$), hydroxyl (OH), and reactive nitrogen species (RNS) such as nitric oxide (NO), nitrogen dioxide ($NO_2$), etc. The ROS and RNS are created in quantities suitable to kill microorganisms on the perishable goods and within the display case 10 and to neutralize the ethylene produced by the perishable goods. If the ROS and RNS are created in greater quantities, the ROS and RNS may start to react with the perishable goods and thus, shorten the life of the perishable goods. Alternatively, if the ROS or RNS are created in lesser quantities, the microorganisms would multiply substantially unchecked and the ethylene would be allowed to accumulate, thus shortening the life of the perishable goods.

Another major difference between the present invention and the EDH of U.S. Pat. No. 2,765,975 is that the EHD of U.S. Pat. No. 2,765,975 moves neutralized air at a substantial velocity and is used in place of a fan. In contrast, the present invention moves air with ROS and RNS at a relatively slow velocity to permit the ROS and RNS to have elongated contact with the perishable goods. If the air moves too quickly, the ROS and RNS do not have time to react with the ethylene and kill the microorganisms on the perishable goods and in the display case 10.

As shown in FIG. 1, the EHD 30 moves air as described above and directs the air along an air flow path designated by arrows 36. The air flow path defines an air curtain over the products within the display area. The air is discharged into the display space from the top through a discharge outlet and the air exits the display space at the bottom from of the case through a return inlet. From the return inlet, the air is recirculated through the EHD 30. Alternatively, the air can flow in the opposite direction around the display case 10. A plurality of EHD 30 units can be positioned along the bottom of the display case 10 or an elongate EHD 30 unit can extend along substantially an entire width of the display case 10.

Figure 2:
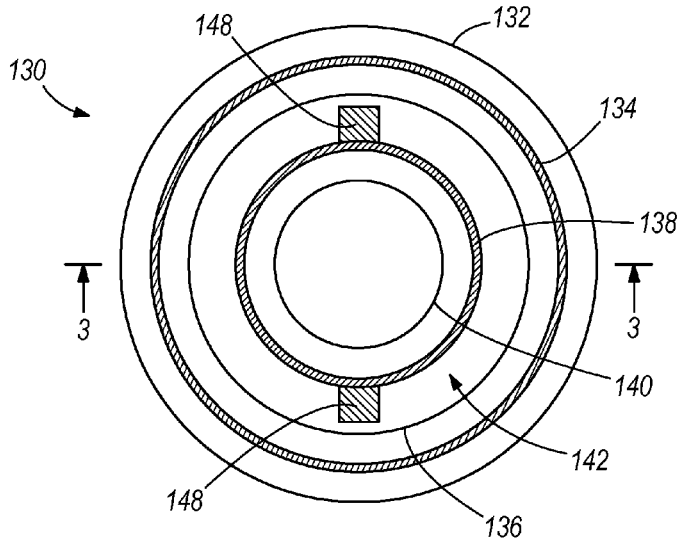
FIG. 2 is an end view of an electro hydrodynamic thruster according to some embodiments of the present invention.
Figure 3:
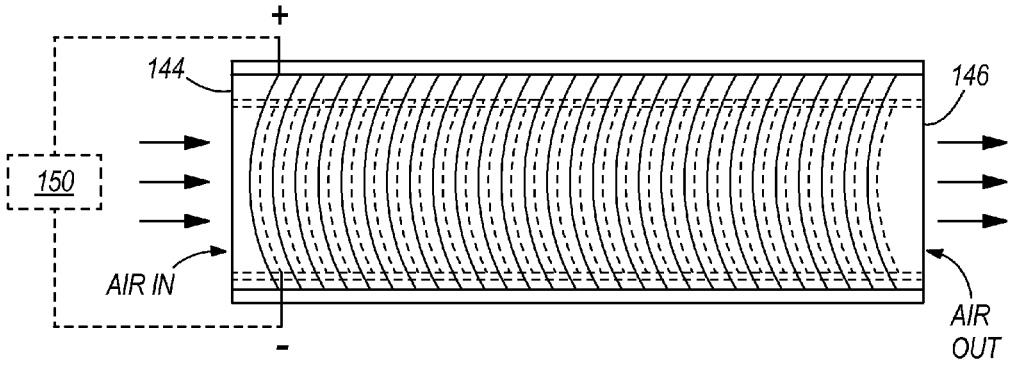
FIG. 3 is a cross-sectional view of the electro hydrodynamic thruster taken alone line 3-3 of FIG. 2.

An alternative construction for an EHD thruster 130 is shown in FIGS. 2 and 3. The EHD thruster 130 includes a first insulating tube 132, an ion collector 134, a second insulating tube 136, a corona wire 138, and an inner tube 140. An air space 142 is defined between the second insulating tube 136 and the corona wire 138. Air flows in an air inlet 144 and out an air outlet 146. A plurality of spacers 148 are placed in the EHD thruster 130 between the second insulating tube 136 and the corona wire 138 to maintain the desired air space 142. At least one of the corona wire 138 and inner tube 140 can have a spiral design, and thus are easily adapted to different length EHD thrusters 130 because of the spiral design. The corona wire 138 and inner tube 140 can easily be removed from the outer insulating tube 132 for cleaning or replacement.

A power source 150, such as an electrical outlet or a battery, is connected to the EHD thruster 130 near the air inlet 144 and is connected to at least one of the ion collector 134 and the corona wire 138 to power the EHD thruster 130.

In operation, the EHD thruster 130 can be inserted into a display case, such as the display case 10 of FIG. 1 and can be powered by an electrical outlet or a battery to create a charge near the air inlet 144 and thereby move air through the EHD thruster 130 without requiring the use of any moving parts (e.g., a fan or blower).

The EHD thruster 30, 130 produces ROS and RNS and moves the ROS and RNS along a flow path in the display case by means of an ion wind. The ROS and RNS react with at least some of the ethylene and kill at least some of the microorganisms on the perishable goods and in the display case. The EHD thruster lengthens the shelf life of the perishable goods without or without the use of refrigeration.

In embodiments that utilize an evaporator coil of a refrigeration unit, one or more fans of the refrigeration unit can passively or actively move air through the EHD thruster. For example, the one or more fans can directly move air though the EHD thruster, or can create a small vacuum to draw air into or out of the EHD thruster. In other embodiments, the refrigeration unit can omit any fan or blower and can rely on the ion wind created by the EHD thruster to move air through the evaporator coil.

Various features and advantages of the invention are set forth in the following claims.

What is claimed is:

1. A display assembly for containing and displaying perishable products, the display assembly comprising;

a case having at least one wall and defining an internal volume;

a quantity of gas contained in the case, the gas including ethylene emitted from the perishable products; and an electro hydrodynamic thrust device positioned in the case;

wherein the electro hydrodynamic thrust device is configured to generate an ion wind and ionize a portion of the quantity of gas, wherein the ionized gas includes at least one reactive oxygen species, and wherein the at least one reactive oxygen species reacts with the ethylene to break down the ethylene.

2. The display assembly of claim 1, wherein the electro hydrodynamic thrust device is configured to ionize the portion of the quantity of gas without the use of a blower.

3. The display assembly of claim 1, wherein the at least one reactive oxygen species includes at least one of atomic oxygen, ozone and hydroxyl.

4. The display assembly of claim 1, wherein the quantity of gas includes water vapor.

5. The display assembly of claim 1, wherein the electro hydrodynamic thrust device is configured to generate the ion wind to propel the quantity of gas without the use of a blower.

6. The display assembly of claim 1, wherein the at least one reactive oxygen species interacts with at least some pathogens and bacteria in the display case to thereby sanitize the display case.

7. The display assembly of claim 1, wherein the perishable products include at least one of fruits and vegetables.

8. The display assembly of claim 1, wherein the perishable products include flowers.

9. The display assembly of claim 1, wherein the display assembly is a non-refrigerated display assembly.

10. The display assembly of claim 1, wherein the ionized gas includes at least one reactive nitrogen species.

11. The display assembly of claim 1, further comprising a power source operable to provide a flow of current to the electro hydrodynamic device.

12. A method of retrofitting a display case for displaying perishable food, the method comprising:

inserting an electro hydrodynamic thrust device into the display case;

connecting the electro hydrodynamic thrust device to a power source;

creating an ion wind with the electro hydrodynamic thrust device;

moving air through the electro hydrodynamic thrust device with the ion wind;

ionizing the air in response to reacting the air with the ion wind;

creating reactive oxygen species in response to ionizing the air;

directing the reactive oxygen species into the display case with the thrust of the ion wind;

sanitizing at least one surface in the display case with reactive oxygen species; and reacting ethylene emitted from the perishable food with the reactive oxygen species to break down the ethylene in the display case, thereby reducing the quantity of ethylene in the display case.

13. The method of claim 12, wherein moving the air with the ion wind includes moving the air without a blower.

14. The method of claim 12, further comprising providing perishable food in the display case prior to reacting the ethylene with the reactive oxygen species.

15. The method of claim 12, wherein creating the ion wind with the electro hydrodynamic thrust device does not require movement of any parts.

16. The method of claim 12, further comprising lengthening the shelf life of perishable food in the case in response to reacting the ethylene with the reactive oxygen species.

17. The method of claim 16, wherein the lengthening the shelf life is achieved without the use of refrigeration.

18. The method of claim 12, further comprising creating reactive nitrogen species in response to ionizing the air.

19. A display assembly for containing and displaying perishable products, the display assembly comprising;

a case having at least one wall and defining an internal volume;

a quantity of gas contained in the case, the gas including ethylene emitted from the perishable products and water vapor;

an electro hydrodynamic thrust device positioned in the case; and a power source operable to provide a flow of current to the electro hydrodynamic device, wherein the electro hydrodynamic thrust device is configured to generate an ion wind and ionize a portion of the quantity of gas without the use of a blower, wherein the ionized gas includes at least one reactive oxygen species and at least one reactive nitrogen species, wherein the at least one reactive oxygen species and reactive nitrogen species reacts with the ethylene to break down the ethylene, and interacts with at least some pathogens and bacteria in the display case to thereby sanitize the display case, wherein the at least one reactive oxygen species includes at least one of atomic oxygen, ozone and hydroxyl, wherein the electro hydrodynamic thrust device is configured to generate the ion wind to propel the quantity of gas without the use of a blower, and wherein the perishable products include at least one of fruits, vegetables and flowers.

* * * * *